US006282755B1

(12) United States Patent
Strobel et al.

(10) Patent No.: US 6,282,755 B1
(45) Date of Patent: Sep. 4, 2001

(54) PROCESS AND TEXTILE MACHINE FOR FEEDING FIBER SLIVERS TO DRAFTING EQUIPMENT

(75) Inventors: Michael Strobel, Eichstätt; Armin Brunner, Elsendorf, both of (DE); Lars Weisigk, Winterthur (CH)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/428,251

(22) Filed: Oct. 27, 1999

(30) Foreign Application Priority Data

Nov. 4, 1998 (DE) ..... 198 50 780

(51) Int. Cl.[7] ..... D01G 15/40
(52) U.S. Cl. ..... 19/105; 19/150; 19/236
(58) Field of Search ..... 19/105, 98, 106 R, 19/236–240, 150, 151, 263; 57/304, 308, 315, 75, 90

(56) References Cited

U.S. PATENT DOCUMENTS

| | | | | |
|---|---|---|---|---|
| 2,944,302 | * | 7/1960 | West | 19/150 |
| 3,020,600 | * | 2/1962 | West | 19/150 |
| 3,035,313 | * | 5/1962 | Naegeli et al. | 19/150 |
| 3,362,049 | * | 1/1968 | Kiser | 19/150 |
| 3,432,891 | | 3/1969 | West . | |
| 4,224,719 | | 9/1980 | Beatrice . | |
| 4,259,766 | * | 4/1981 | Copoulos | 19/150 |
| 4,357,793 | * | 11/1982 | Gasser et al. | 19/263 |
| 5,018,248 | * | 5/1991 | Haworth et al. | 19/236 |
| 5,195,314 | | 3/1993 | Hans . | |
| 5,459,992 | * | 10/1995 | Tsuzuki | 57/90 |
| 5,839,165 | * | 11/1998 | Patelli et al. | 19/236 |
| 5,855,043 | | 1/1999 | Ferdinand . | |
| 5,983,456 | * | 11/1999 | Leifeld | 19/150 |

FOREIGN PATENT DOCUMENTS

| | | |
|---|---|---|
| 938832 | 2/1956 | (DE) . |
| 4113887 | 10/1992 | (DE) . |
| 4123453 | 1/1993 | (DE) . |
| 317733 | 5/1989 | (EP) . |
| 775768 A1 | 5/1997 | (EP) . |

OTHER PUBLICATIONS

German Search Report, Application No. 198 50 780.1, dated May 16, 1999.

* cited by examiner

*Primary Examiner*—John J. Calvert
*Assistant Examiner*—Gary L. Welch
(74) *Attorney, Agent, or Firm*—Dority & Manning

(57) ABSTRACT

In a process for feeding of textile fibers supplied from a point of delivery of a textile machine to a drafting equipment which continues to process the fibers, the fibers supplied from the point of delivery are formed into a fiber sliver. They are then conveyed in the form of the fiber sliver to a drafting equipment which continues to process the fiber sliver, whereby the fibers are conveyed at least in the area before the drafting equipment by a feed mechanism and are introduced by same into the drafting equipment. In a textile machine to carry out the process, the feed mechanism is provided with a conveying channel which is located between the point of delivery and the input area of the drafting equipment and which conveys the fiber sliver. The conveying channel reaches up to the input area of the drafting equipment. The feed mechanism is provided with a drive arrangement for the conveying of the fiber sliver in the conveying channel.

28 Claims, 5 Drawing Sheets

PROCESS AND TEXTILE MACHINE FOR FEEDING FIBER SLIVERS TO DRAFTING EQUIPMENT

BACKGROUND

The present invention relates to a process for the feeding of textile fibers to a drafting equipment, as well as to a textile machine with a feeding mechanism.

A method is known from DE-OS 29 11 744 by which a ready reserve sliver is fed to the drafting equipment in case that a presented sliver breaks. In this method, the fiber slivers being fed to the drafting equipment are monitored by means of sensors in the direction of sliver movement in the area before the feed point to ascertain their presence. If a sensor detects that a sliver is missing, the feed mechanism of the reserve sliver is actuated. The reserve sliver is fed in such a manner in that case, that the beginning of the reserve sliver is introduced at the point where a textile fiber sliver is missing due to a breakage or because it has run out. The reserve sliver is laid on a still existing sliver so as to overlap it, and so that it is carried along with said sliver and is fed to the rollers of the drafting equipment. Therefore, it is necessary in order to introduce the fiber sliver into the drafting equipment, that at least one fiber sliver is still present and is connected to the drafting equipment or has already been seized by the draw-in rollers.

DE 197 21 758 A1 discloses a device on a carding machine, on which a nap funnel is installed with draw-off rollers at the output of the carding machine. Between the nap funnel and the sliver intake opening of the depositing plate, drafting equipment is installed. The fiber sliver is drawn off by the draw-off rollers after the nap funnel. The fiber sliver runs via a deflection roller to a sliver funnel which is located before the drafting equipment.

The devices shown in the state of the art have the disadvantage that either a sliver must still be present so that an introduction of the fiber sliver newly to be introduced is possible, or that the fiber sliver can be introduced into the drafting equipment only by hand.

SUMMARY

It is a principal object of the present invention to propose a process for the feeding of textile fibers to a drafting equipment which avoids the disadvantages of the state of the art, as well as a textile machine with a feed mechanism for the feeding of a fiber sliver delivered from a delivery point which facilitates or simplifies the introduction of a fiber sliver into a drafting equipment considerably. Additional objects and advantages of the invention are set forth in the following description, or may be obvious from the description, or may be learned through practice of the invention.

The process according to the invention for the feeding of textile fibers to a drafting equipment may be characterized in that the fibers presented by the point of delivery are formed into a fiber sliver and are then conveyed in form of the fiber sliver to a drafting equipment which carries out continued processing of the fiber sliver, whereby the fibers are conveyed by a feed mechanism at least in the area before the drafting equipment and are introduced by said feed mechanism into the drafting equipment. The process makes it advantageously possible to considerably facilitate the handling of the textile fibers or of a fiber sliver composed thereof on a textile machine. It is thus advantageously possible to design the introduction of the fiber sliver into the drafting equipment in a much more effective manner and to also accelerate this considerably in time. This is especially advantageous when the delivery speed on the textile machine is high and cannot be lowered at will, so that a manual handling does not make it possible to introduce the fibers into the drafting equipment at the required speed. The process according to the invention thus makes it possible on textile machines on which the feeding speed cannot be lowered or cannot be lowered significantly to achieve nevertheless satisfactory and sufficiently rapid transfer of the fibers or of a fiber sliver consisting thereof to a drafting device or drafting equipment. This ensures a secure interconnection of the components of the textile machine even when difficult problems are to be solved. In particular the area before the drafting equipment presents an especially difficult point for the handling of the fibers or of the fiber sliver, since the drafting rollers are for the most part already closed and the draw-in roller of the drafting equipment already rotates so that the introduction of a fiber sliver requires special skill and at the same time represents a dangerous spot since, in the worst scenario, the rotating rollers of the drafting equipment may cause injuries. Thanks to the process according to the invention, the especially difficult part of the fiber feeding process is taken over by a device which is able to work faster than an operator and at the same time secure introduction of the fibers into the drafting equipment is made possible without any risk of injury to an operator. The area before the drafting equipment which is provided with a feed mechanism according to the process of the invention is in particular the area between the drafting equipment and a deflection point of the fiber sliver upstream of it, in direction of sliver movement or some other device, e.g. a pair of scanning rollers which scans the fiber sliver to measure its condition in a regulated draw fame. According to the invention, the beginning of the conveyor of the fiber sliver is provided following such a location, whereby a sufficient distance remains between this "interference point" and the beginning of the conveyor in an especially advantageous embodiment so that an operator or an automatic service device, e.g. with an automatic grasper on a robot arm, can still grasp the fiber sliver and transfer it to the feed mechanism. At the same time, it is also possible with the process according to the invention for the fiber sliver to be taken or conveyed by the conveyor over one or several so-called interference points in the path of the fiber sliver. For this purpose several feed mechanisms, e.g. in a row one after the other, can be used advantageously according to the invention, or the device may be provided with several of them. It is especially advantageous for at least two thereof to be provided with their own drives. According to the invention, the feed mechanism should be able to introduce the fiber sliver into the drafting equipment. The length of time during which the fiber sliver is conveyed already before by the feed mechanism is unimportant for the basic idea of the present invention.

In order to facilitate the feeding of the fibers, it is especially advantageous to form the fibers delivered from the delivery point first into a fiber sliver without rotating them. This can be provided advantageously directly after the delivery point of the textile fibers. The utilization of a nap funnel for this purpose is especially advantage, this funnel being able to form the delivered fibers into a fiber sliver as e.g. in carding machines. The fiber sliver formed by the nap funnel is drawn off from the nap funnel especially advantageously by means of conveyor rollers.

In another advantageous process, the delivered fibers or the formed fiber sliver is transferred in a controlled manner to the feed mechanism, whereby this operation can advantageously be carried out by hand or, depending on the other design features of the textile machine, by a transfer device which transfers the fibers or the fiber sliver to the feed mechanism. This can be effected advantageously by the grasper of a robot. The controlled transfer makes it advantageously possible to achieve reliable and rapid transfer of the fiber sliver to the conveyor. In another advantageous embodiment of the process according to the invention, the feeding speed of the fiber sliver is lowered below the normal operating speed of the textile machine in order to facilitate the handling or introduction into the drafting equipment, and also the introduction of the fiber sliver into the feed mechanism. For this purpose, the speed of the fiber sliver is lowered especially advantageously to below 50% of the normal delivery speed. In another advantageous embodiment of the process according to the invention, the suction on the drafting equipment is reduced to such an extent in order to introduce the fiber sliver into the drafting equipment, that the introduction of the fiber sliver is not hindered or rendered more difficult. In an especially advantageous embodiment of the process according to the invention, the suction on the drafting equipment is in this case stopped only intermittently, so that suction is not switched off during the entire process of inserting the fiber sliver into the drafting equipment. This makes it possible to utilize the advantageous effects of suction also during the feeding process.

In another advantageous embodiment, the drafting rollers are already closed for the introduction of the fiber sliver into same. The advantageous result of this is that the draw-in rollers of the drafting equipment can already be taken into operation, so that they can contribute actively to the introduction of the fiber sliver through the rotation of the rollers. Pneumatic conveying of the fiber sliver is especially advantageous. In this manner, the fiber sliver is handled sufficiently rapid and securely without disturbing its structure. This conveying air is removed advantageously in the area before the drafting equipment as seen in the feed direction, so that the conveying air or the air transported along in the fiber sliver may not hinder the introduction of the fiber sliver into the drafting equipment due to the fact that fibers or the fiber sliver are carried along by the escaping air. The conveying air together with the fiber sliver are advantageously conveyed in a conveying channel, whereby the conveying air is moved the inner wall of the conveying channel, so that the friction of the fiber sliver against the conveying channel is reduced considerably during its travel. In another advantageous embodiment of the invention, the conveying air is shut off after the introduction of the fiber sliver into the drafting equipment. This reduces in particular the energy consumption of the textile machine. In another advantageous embodiment of the process according to the invention, a conveyor conveys the fiber sliver from the delivery point to the drafting equipment. This makes it possible to transfer the fibers or a fiber sliver from one delivery point to a drafting equipment without manual intervention, so that the textile machine can thus be 100% automated.

In an especially advantageous development of the invention, a regulated or controlled drafting equipment is used, which is controlled through signals of a measuring device which measures the fiber sliver. Regulation or control is essentially understood to mean a process which makes it possible to correct irregularities in the fiber sliver by means of the drafting equipment, whether or not regulation or control is applied in the technological regulating sense. At least for the area going from the measuring device to the drafting equipment, a feed mechanism is then used By using such a drafting equipment, in particular irregularities in the fiber sliver which were produced by the transportation can again be evened out.

The textile machine according to the invention, with a feed mechanism, has the advantage that the introduction of the fiber sliver into the drafting equipment can be effected readily and reliably. The delivery speeds on a textile machines permit less and less the handling of the fiber sliver without having to stop the textile machine. The device according to the invention makes it possible nevertheless to handle the fiber sliver, precisely at a critical location, and to introduce it into the drafting equipment reliably, without danger to an operator. In an especially advantageous embodiment of the device the conveying channel extends to immediately before the input zone of the drafting equipment, i.e. the feed mechanism is advantageously at a distance between 25 mm and 15 mm, and especially advantageously at a distance of less than 15 mm from one of the input rollers of the drafting equipment, so that secure transfer of the fiber sliver to the drafting equipment rollers is achieved. The drafting equipment is advantageously screened by a cover from its environment, so that dust and pollutants can be removed from the area of the struts.

According to the invention the feed mechanism reaches from the outside through the cover to the drafting equipment, with the advantage that the cover need not be opened when handling the sliver at the feed mechanism, e.g. during introduction. In an especially advantageous further development of the invention a drive to assist the conveying of the fiber sliver is provided on the conveying channel, to especial advantage at its beginning, so that an active feeding of the fiber sliver to the drafting equipment is achieved. The length of the conveying channel has thereby barely any influence on the reliable feeding of the fibers to the drafting equipment and on the grasping of the fiber sliver by the conveyor. Especially in case of long distances to be bridged, several conveyors can be provided, of which several may be provided with their own drive.

In an advantageous further development the drive consists of a pneumatically driven device which conveys the fiber sliver in the direction of the drafting equipment by means of an air stream. This makes it possible to convey the fiber sliver gently and at the same time rapid and reliably.

A ring-shaped drive arrangement which reaches around the fiber sliver is especially advantageous because in this manner the fiber sliver can be impelled on its entire circumference by the conveyor. The drive arrangement is provided advantageously with one or several nozzles producing an air stream parallel to the sliver, so that the sliver is conveyed securely and gently especially also in a conveying channel. For this purpose the drive arrangement is provided with nozzles to expel air which is screened by a cover from the fiber sliver, so that direct blowing of air on the fiber sliver is avoided. This direct blowing could result in disturbing the structure of the fiber sliver.

In an especially advantageous embodiment of the feed mechanism the nozzles consist essentially of a ring-shaped groove provided with a groove with axial depth, since this ensures especially gentle and secure transportation of the air together with the fiber sliver in the conveying channel.

The conveying air for the fiber sliver emerges exactly in the conveying direction of the fiber sliver along the walls of the conveying channel. The design of the nozzle in form of cylindrical sleeve surfaces at a distance from each other ensures a continuous, undisturbed flow parallel to the fiber sliver.

An advantageous further development in which the drive arrangement has a smaller inside diameter than the conveying channel, undisturbed blowing of the conveying air into the conveying channel is advantageously made possible.

In another advantageous further development of the invention the drafting equipment is provided with a cover which screens the drafting equipment from its environment so that no pollution of the drafting equipment is possible and inversely, to allow for undisturbed suction of the drafting equipment for the removal of dust. The feed mechanism extends in this case advantageously from outside the cover under the cover and to the drafting equipment. This has the advantage that the cover of the drafting equipment need not be opened for the introduction of the fiber sliver into the feed mechanism.

In an advantageous further development of the invention the drive arrangement is located at the beginning of the conveying channel as this makes a secure grasping of the fiber sliver by the conveyor possible. The drive arrangement is divisible in an advantageous further development, so that it can be swiveled away from the fiber sliver once the latter has been grasped by the drafting equipment. In addition the conveyor is advantageously provided with one or several points of separation extending in the running direction of the fiber sliver.

In an advantageous further development, the conveying channel is designed so as to be adjustable in the direction of fiber conveying. This makes it possible to adjust the most favorable position between the end of the conveying channel and the beginning of the input rollers of the drafting equipment in order to grasp the sliver securely. In an especially advantageous further development, the conveying channel and the input rollers of the drafting equipment are designed so as to be adjustable. This has the advantage that when the drafting equipment is adjusted, the conveying channel is adjusted simultaneously with it, so that always the same conditions exist for the introduction of the fiber sliver into the drafting equipment. For this, the conveying channel is advantageously attached on adjustable supports, the stanchions of the input rollers of the drafting equipment.

In order to make undisturbed introduction of the fiber sliver into the drafting equipment possible, the invention provides for the conveying channel to be provided with an air venting opening on its end towards the drafting equipment, which removes the air which was conveyed together with the fiber sliver so that it may not interfere with the introduction of the fiber sliver into the drafting equipment. Advantageously, the air venting opening for this is essentially perpendicular to the direction of the fiber sliver, preferably going upward. In an especially advantageous further development of the invention, the conveying channel can be swiveled at least partially away from the fiber sliver. In normal operation of the spinning machine with a feed mechanism, the conveying channel is then not subjected to wear by the conveyed fiber sliver. For this purpose, the conveying channel can preferably be raised so that the fiber sliver lies untouched and the conveying channel is subjected to less friction by the fiber sliver and no dirt is deposited in the conveying channel.

A configuration of the conveying channel in the form of a pipe with a circular cross-section is especially advantageous. In another embodiment, the conveying channel can advantageously be in several parts, e.g. to facilitate cleaning and positioning of the conveying channel. Thanks to a divisibility of the conveying channel in the longitudinal direction, it can be swiveled away completely out of the area of the fiber sliver.

In an advantageous further development of the invention, the conveying channel lets out near the drafting equipment in such a manner as related to the drafting rollers that its center line lets out in the area between upper and lower roller. As a result, the fiber sliver is presented to the drafting equipment in such a manner that it can be securely grasped. The center line is in this case advantageously positioned so that the center line between the axis of the upper roller and the axis of the lower roller is aimed at the pair of draw-in rollers of the drafting equipment. It is especially advantageous for the center line to let out in the area of the upper roller of the drafting equipment because in this way the fiber sliver is introduced especially securely into the nip between the upper and the lower roller.

The conveying channel is advantageously provided near its outlet before the drafting equipment with a fiber spreading device which ensures that the fiber sliver is already spread out somewhat to match the horizontal drafting rollers, as this facilitates the introduction considerably.

In an especially advantageous further development of the invention, the drafting equipment is a regulated or controlled drafting equipment which is equipped with a measuring device which scans the fiber sliver. This enables the drafting equipment to continue the processing of the fiber sliver in a regulated or controlled manner, so that its structure is improved or so that transportation damages are compensated for. The feed mechanism is equipped with a transferring device which is mounted e.g. on the textile machine in order to transfer the fiber sliver to a great extent or completely without human intervention from the delivery point to the conveying channel. The feed mechanism can thereby operate independently and automatically and can introduce the fiber sliver into the drafting equipment. The transferring device in this case can advantageous be made in form of a robot arm or a grasper of the fiber sliver.

The invention is described in further detail below through drawn figures.

DETAILED DESCRIPTION

Reference will now be made in detail to presently preferred embodiments of the invention, examples of which are shown in the figures. Each example is provided by way of explanation of the invention, and not meant as a limitation of the invention. For example features illustrated or described as part of one embodiment can be used with another embodiment to yield still a further embodiment. It is intended that the present invention include modifications and variations to the embodiments described herein.

Figure 1:
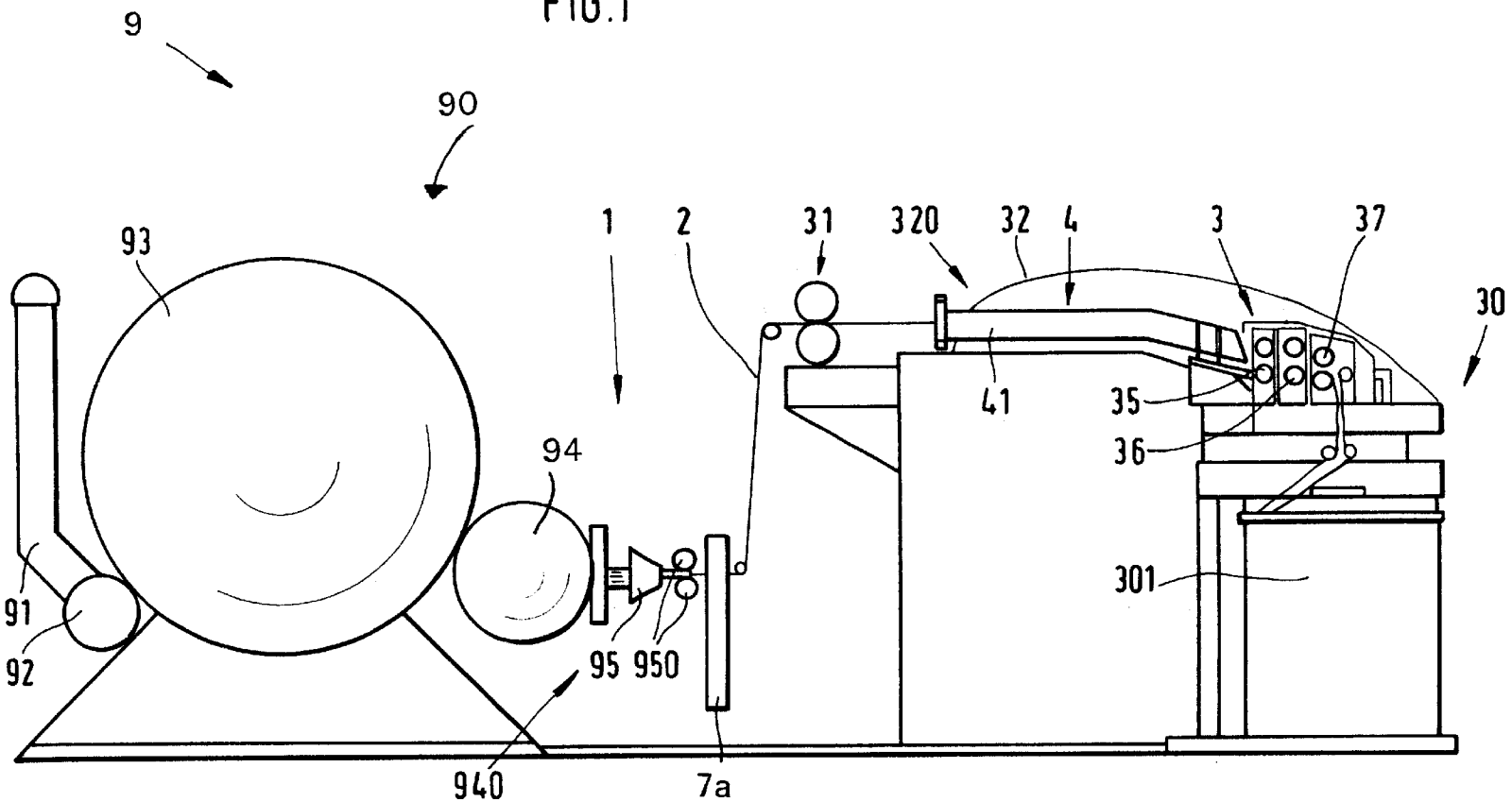
FIG. 1 shows a textile machine according to the invention.

FIG. 1 shows a schematic drawing of a textile machine (9) which carries out essentially the function of a carding machine with downstream sliver deposit. The textile machine (9) consists essentially of a part which produces a sliver containing elements of a carding machine (90), producing and delivering a fiber sliver (2). For this purpose the textile machine is provided with a fluff conveying system (91) which transfers fibers shaped into a tuft to a licker-in (92) to be then transferred from the licker-in (92) to a drum (93). The fibers are taken by a doffer (94) from the drum (93). Together with additional elements the doffer (94) represents the exit of a carding machine at the end of which a fiber sliver (2) is formed. The additional elements of the exit (940) are essentially a sliver funnel (95) and conveyor rollers (950) following it. They constitute finally the point of delivery of the fibers to be conveyed or of the fiber sliver (2) to be conveyed.

In its continued course, the fiber sliver reaches a drafting equipment (3) which further processes the fiber sliver and transfers it to a sliver deposit (30) which deposits the fiber sliver in a known manner in a can (301). In the textile machine of FIG. 1, the drafting equipment (3) is designed as a regulated drafting equipment so that the sliver passes a measuring device 31 or, depending on the configuration of the latter, passes through it before entering the drafting equipment.

In the present textile machine (9), the drafting equipment consists of three pairs of drafting rollers, each with one upper and one lower roller. The pair of output rollers (37) is located on the side of the drafting equipment towards the sliver deposit (30), and on the other side of the drafting equipment (3) is the pair of input rollers (35). The middle cylinders (36) are located between the pair of input rollers (35) and the pair of output rollers (37). The middle cylinders (36) and the pair of input rollers (35) can be adjusted relative to the pair of output rollers (37) so as to be able to effect different adaptations to the material to be drafted on the drafting equipment (3). A cover (32) extends over the drafting equipment (3) and the sliver deposit (30), protecting the drafting equipment (3) on top and laterally from its environment. As a result, dirt is prevented from entering the area of the drafting equipment (3) and prevents as well dust from coming out of the drafting equipment (3) and into the environment. A suction system (320) is furthermore located beneath the cover (32) to suck individual fibers and dirt particles that may occur in the area of the drafting equipment (3) from same.

The feed mechanism (4) according to the invention is located between the pair of input rollers (35) of the drafting equipment (3) and the measuring device (31). The feed mechanism (4) consists essentially of a conveying channel (41) which extends from outside the cover (32) of the drafting equipment (3) through said cover (32) in the direction of sliver movement until before the pair of input rollers (35).

A sliver storage (7*a*) is located between the conveyor rollers (950) and the measuring device (31) for the interim storage of the loop of the fiber sliver (2) which forms in case of uneven, i.e. excessive or insufficient, sliver draw-off by the drafting equipment. The sliver storage (7*a*) may contain sensors and a control unit which take certain measures on the drafting equipment when a certain degree of fullness is reached or which intervene at the brake signal point of delivery (1) in order to reduce the size of the loop of the fiber sliver (2) in the sliver storage (7*a*) or to enlarge it as required.

Figure 2:
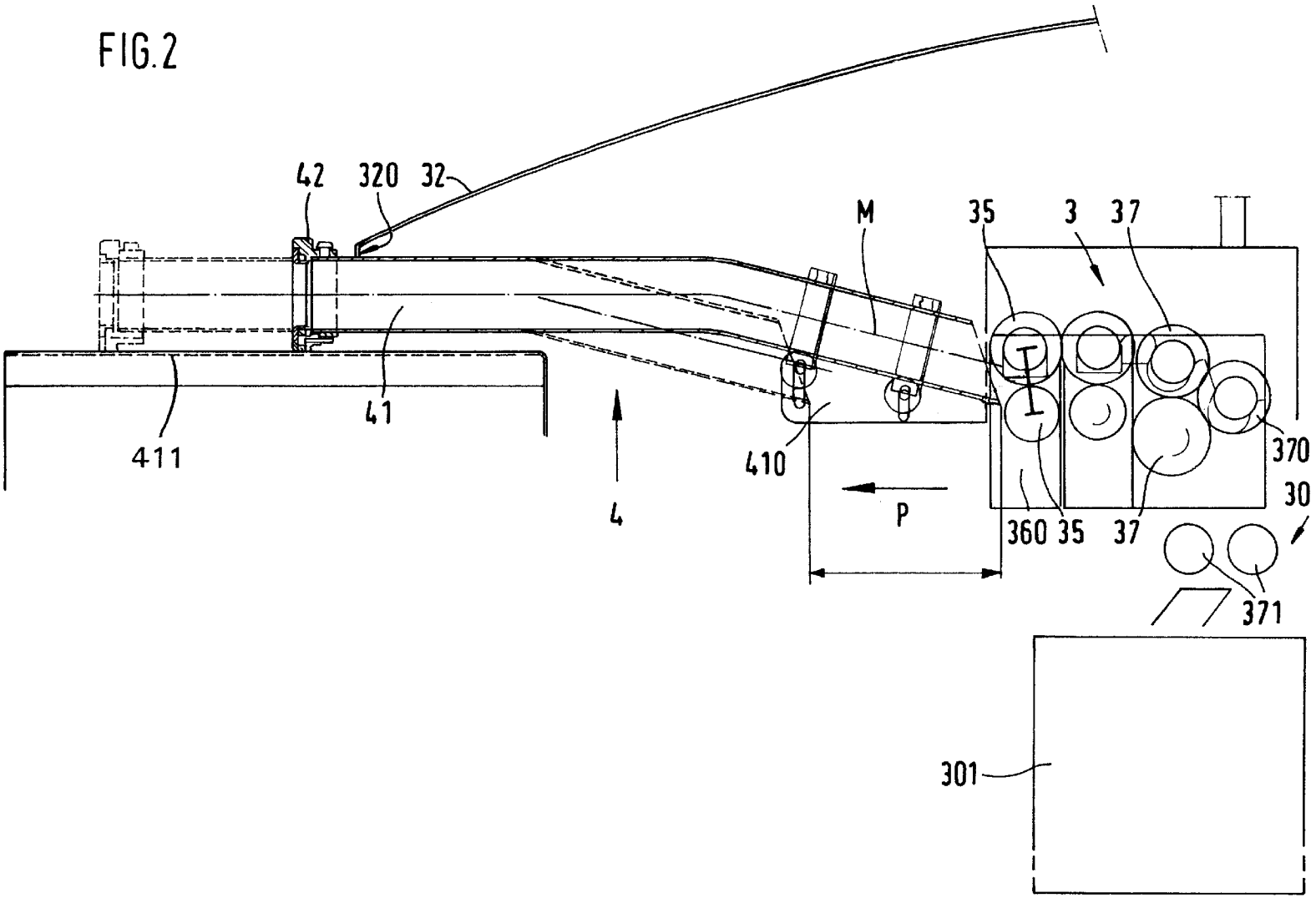
FIG. 2 shows a section through the feed mechanism and the drafting equipment.

FIG. 2 schematically shows a lateral view of the drafting equipment according to FIG. 1 with a feed mechanism (4) equipped according to the invention. The feed mechanism (4) consists of a conveying channel (41) having an axis M and a drive arrangement (42) which is located on the end of the conveying channel (41) away from the drafting equipment. The input rollers (35) are mounted in bearings seated in stanchions (360) at the two ends of their respective axes. The stanchions (360) of the pair of input rollers (35) are capable of displacement in the drafting equipment (3) so that the drafting equipment may be adapted to different materials or other conditions of the fiber sliver. The stanchions (360) of the pair of input rollers (35) can be displaced in the arrow direction P in the drafting equipment (3). The drawing of FIG. 2 shows the drafting equipment (3) with the least possible distances between the individual pairs of rollers.

The conveying channel (41) is mounted with its part towards the drafting equipment (3) on a support (410) which is in turn attached by means of fasteners to the stanchions (360) of the input rollers. Thanks to this advantageous design, a displacement of the stanchions of the pair of input rollers (35) causes a simultaneous displacement of the feed mechanism (4) in the same direction. It is advantageous in this case that the distance between the feed mechanism (4) or the conveying channel (41) and the pair of input rollers (35) remains the same even when its stanchions are displaced. The conditions for the introduction of the fiber sliver (2) thus remain completely the same, independently of the adjustment of the drafting equipment itself. In FIG. 2, the two end positions of the conveying channel (41) are shown. A solid line indicates the position which is assumed by the feed mechanism (4) when the drafting equipment is adjusted with a minimum distance between axes, with a broken line indicating the position of the feed mechanism (4) and thereby of its conveying channel (41) and of the drive arrangement (42) in which the stanchions (360) of the pair of input rollers (35) are placed at the maximum distance from the pair of output rollers (37). In this position the drive arrangement (42) has been displaced in the direction of the measuring device (31) and of the exit (940). The feed mechanism (4) bears on its side away from the drafting equipment on an intake plate (411) on which the drive arrangement (42) which is connected to the conveying channel (41) rests.

The drafting equipment (3), as well as part of the feed mechanism (4) and the sliver deposit (30), are covered by the cover (32) (shown schematically). The cover (32) encloses the top and other otherwise freely accessible sides of the drafting equipment. The cover (32) is provided with an opening through which the conveying channel (41) is taken. A seal can be provided between the cover (32) and the conveying channel (41) so that the entire space enclosed by the cover can be subjected to suction.

As seen in the direction of fiber sliver movement, the output rollers (37) are followed by a deflection roller (370) which deflects the fiber sliver from its essentially horizontal direction of movement in order to introduce it into the calender rollers (371). These are part of the sliver deposit (30). With the help of the sliver deposit (30), the fiber sliver is deposited in a can (301).

Figure 3:
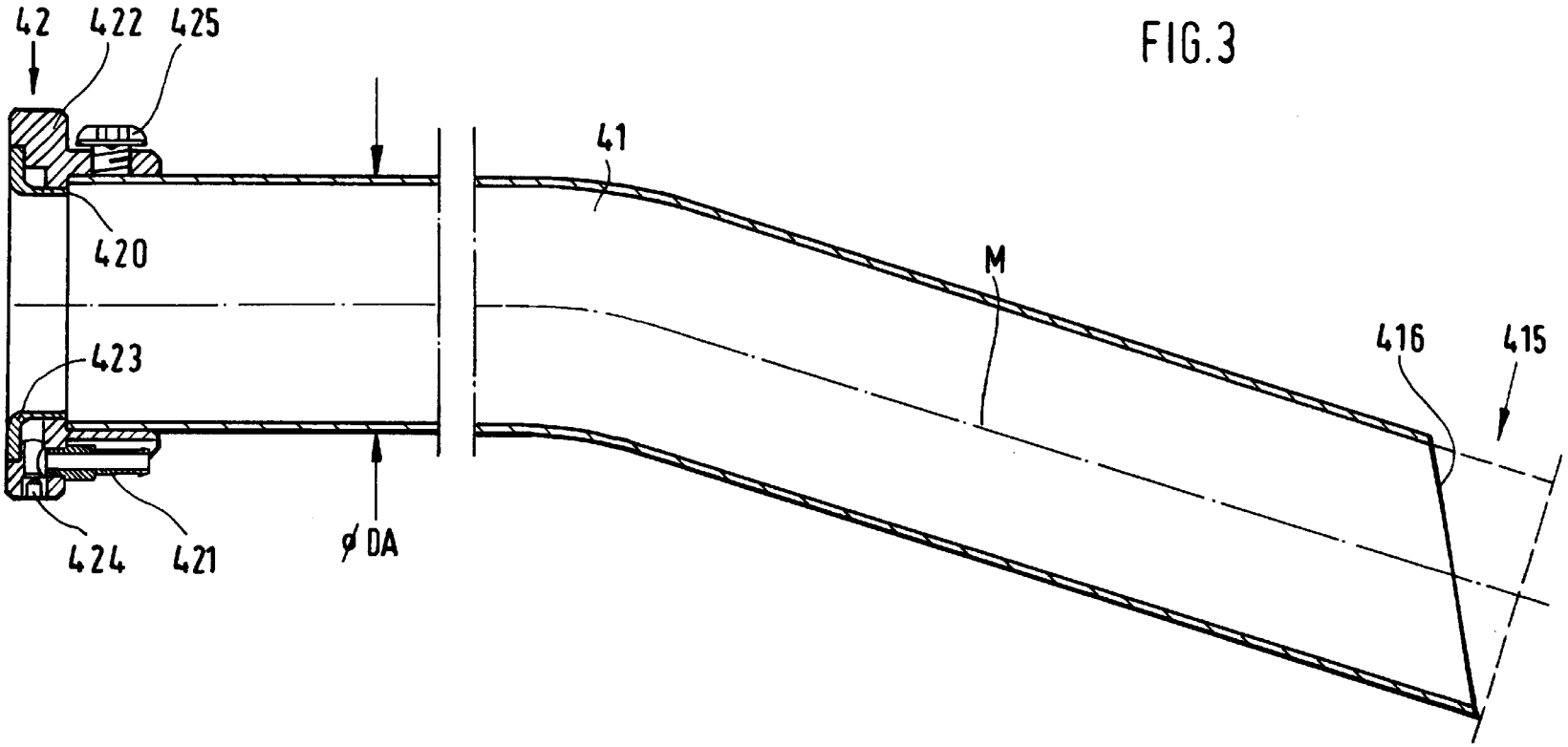
FIG. 3 shows a sections of the conveying device and the conveying channel.

FIG. 3 shows a detailed view of the feed mechanism (4) with the drive arrangement (42) and a tubular piece introduced into the latter, this being the conveying channel (41) in the form of a tube with circular cross-section. The drive arrangement (42) is a pneumatic drive arrangement which produces an air stream in the conveying channel (41) by means of a nozzle (420). For this purpose the drive arrangement (42) is supplied compressed air through the connection piece (421). A pneumatic supply line which is not shown is connected to the connection piece (421) and is supplied with compressed air through a control valve which is controlled by the machine controls of the textile machine. The drive arrangement (42) consists of a support (422) and an insert (423) which is inserted into the support. The connection between the support (422) and the insert (423) can be established by a snap-in connection or e.g. by gluing. The quantity of air supplied through the connection piece (421) can be adjusted, i.e. controlled via an adjusting screw (424). The conveying channel (41) connected to the drive arrangement (42) is held on the drive arrangement (42) by means of a holding screw (425) so that both components are fixedly connected to each other. The drive arrangement (42) is made in the form of a rotationally symmetrical component.

Figure 4:
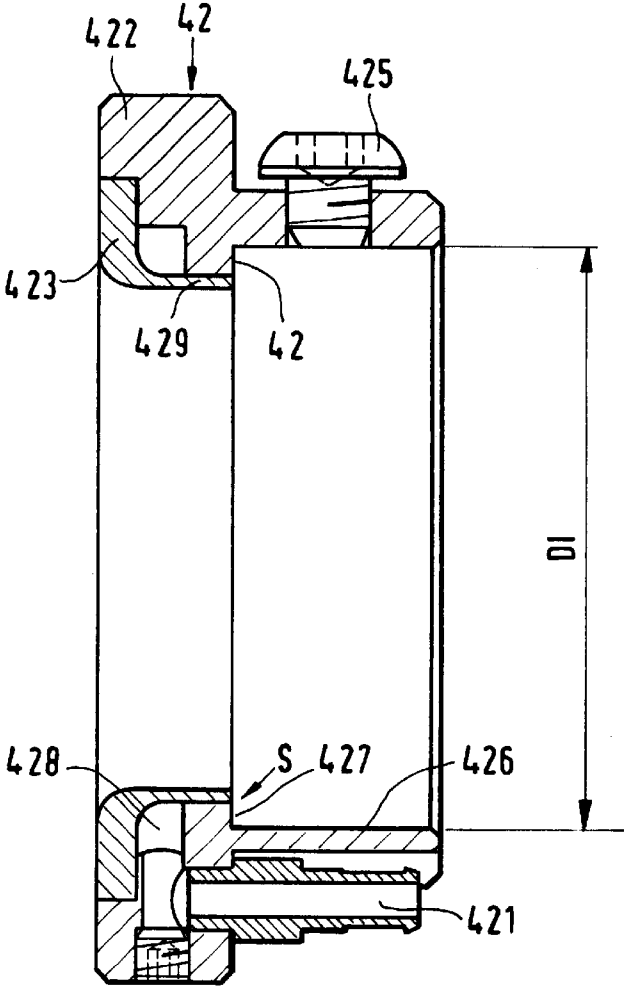
FIG. 4 shows a section through the conveyor.

FIG. 4 shows an enlargement of the drive arrangement (42). The drive arrangement (42) is provided with a seat (426) for the conveying channel which it surrounds radially and for which it also constitutes a stop (427) axially. The inside diameter DI of the seat (426) is here somewhat larger than the outside diameter DA of the conveying channel (41). In this way the conveying channel can easily be introduced into the drive arrangement (42) and can be attached by means of the holding screw (425) in the seat (426) of the drive arrangement (42). A gap S exists between the support (422) and the insert (423) inserted in the support (422). The gap S is connected via chamber 428 to the connection piece (421) so that the chamber 428 can be supplied with compressed air. This air flows from chamber 428 under pressure through the gap S parallel to the side of the seat (426), in the form of a ring-shaped air stream. This air stream enters the conveying channel (41) since the inside diameter of the latter is greater than the diameter of the ring-shaped gap S. Due to the fact that the emerging air constitutes an air stream parallel to the wall of the seat (426) and is at the same time parallel with the inside wall of the conveying channel inserted into the seat (426), the air flows along the tube and its inside wall and at the same time carries along the fiber sliver introduced into the drive arrangement (not shown).

The nozzle (gap S) of the drive arrangement (42) is separated from the fiber sliver running through the insert (423) by the configuration of the insert (423) which is provided with a tubular part (429). Soiling of the nozzle (gap S) is thus reliably prevented, even when no air flows through said nozzle. This operating state occurs for example when the drive arrangement (42) is switched off because the fiber sliver has already been grasped by the drafting equipment.

The insert (423) is advantageously made of a wear-resistant material, e.g. special steel, while the support (422) can be made of plastic, since the support (422) does not come into contact with the fiber sliver. Additional wear-resistant behavior of the insert (423) can be maintained if it is a part coated with a wear-resistant substrate.

Figure 5:
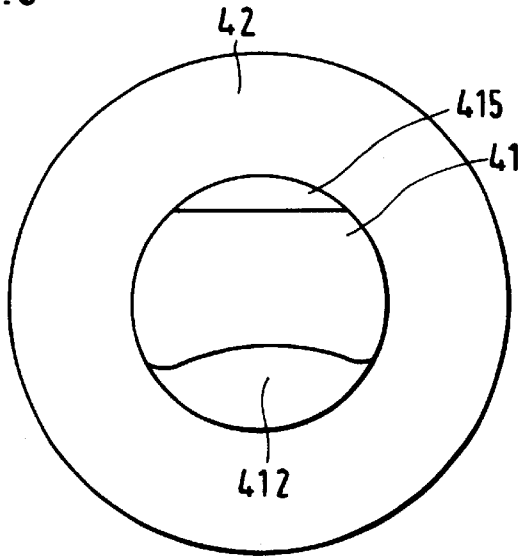
FIG. 5 shows a view similar to a front view of the conveyor.
Figure 6:
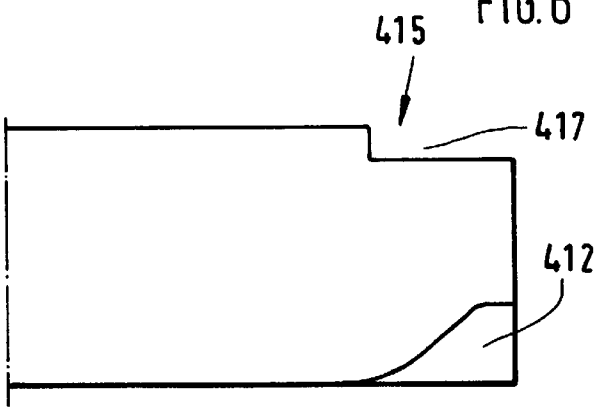
FIG. 6 shows a detail section of FIG. 5.

FIGS. 5 and 6 show a conveying channel (41) with a fiber spreading device (412), with FIG. 6 representing a section of part of the lateral view of FIG. 5. The fiber spreading device is a sheet-metal part inserted into the conveying channel and is installed at the outlet of the conveying channel (41) towards the drafting equipment. The fiber spreading device is made in the form of an insert which causes compression of the sliver at a right angle to the direction of movement, in a plane parallel to the drafting rollers. As a result the sliver becomes flatter and can thus be easily introduced between the drafting rollers.

FIGS. 5 and 6 show in addition the air venting opening (415) which is made in the form of a slit (417) in the longitudinal direction of the conveying channel (41) and which is able to remove the air carried along by the sliver as the sliver is transferred into the drafting equipment. Back pressure of the air in the conveying channel which would interfere with the sliver movement is thereby prevented. In FIG. 3, the conveying channel is provided with an air venting opening which is made in the form of a chamfer 416 of its outlet at the drafting equipment. Other embodiments of an air venting opening such as e.g. one or several bores in the conveying channel can also be used.

Figure 7:
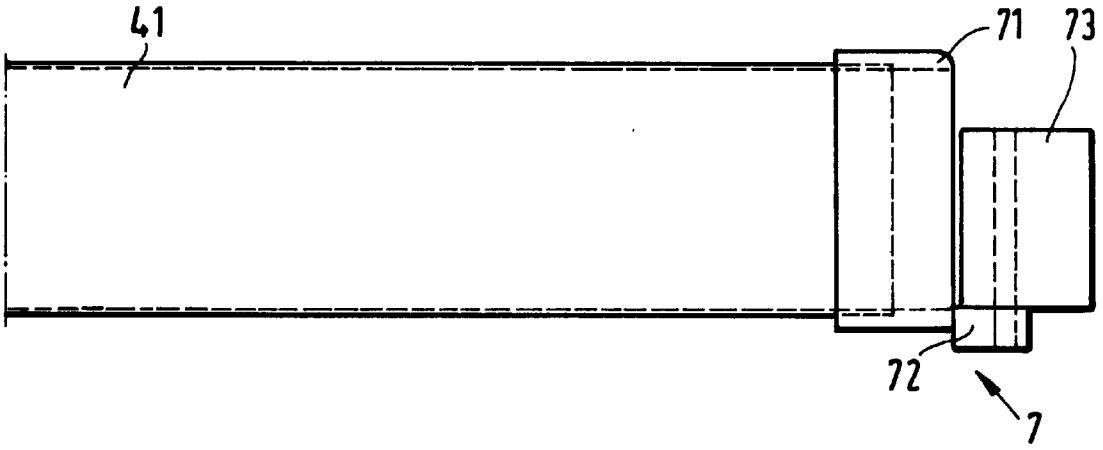
FIG. 7 is a partially lateral view of a conveying channel with a sliver guide.

FIG. 7 shows a conveying channel (41) with a sliver guide (7) provided on its end on the right in the drawing, towards the drafting equipment. The sliver guide (7) consists of a holding ring (71) by means of which it is held on the conveying channel (41), e.g. by a clamping fastener. A ridge (72) is provided on the holding ring (71) and supports in turn two guides (73). In FIG. 7 the fiber sliver (not shown) runs in the conveying channel (41) from left to right. The bottom of the conveying channel (41) is continued by the ridge (72) which supports the sliver from below. Upon leaving the ridge (72) the fiber sliver goes into the drafting equipment.

Figure 8:
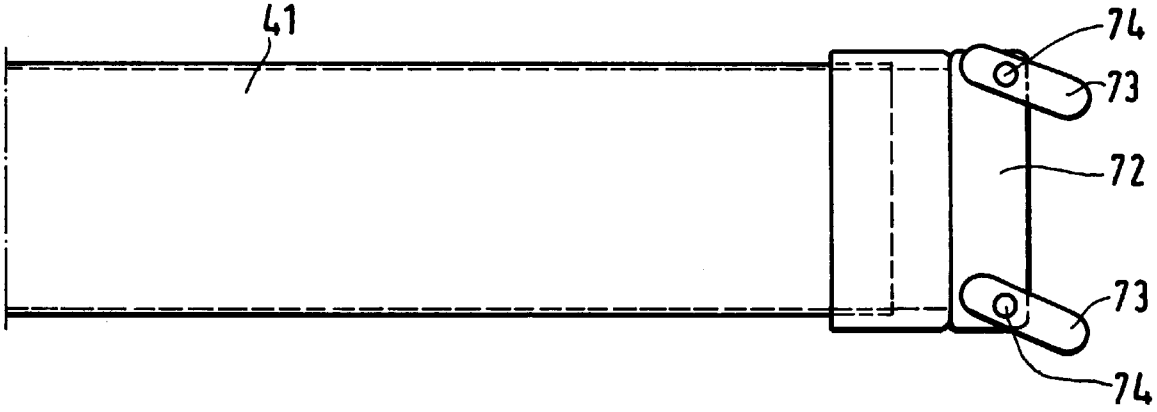
FIG. 8 is a top view of the conveying channel of FIG. 7.

In the top view of FIG. 7 which is represented by FIG. 8 it can be seen that the guides (73) are connected to the ridge (72) via axles (74). The guides (73) are here mounted so as to swivel around the axles (74), so that the sliver can be influenced by the guides (73) in such manner that it enters the drafting equipment at a predetermined location. Thereby it is possible e.g. to correct manufacturing tolerances which cause the conveying channel to introduce the fiber sliver in a non-centered manner into the drafting equipment. A sliver guide (7) is also especially advantageous because it makes a variable utilization of the feed mechanism possible. The sliver guide is in this case advantageously easily adjusted by swiveling around the axles 74. The guides (73) advantageously compensate easily for alignment errors of the conveying channel (41) relative to the center line of the drafting equipment. The design of the ridge (72) in the form of a horizontal surface which is parallel to the plane of the nip between upper rollers and lower rollers has furthermore the advantage that a fiber sliver conveyed in a round conveying channel spreads out horizontally, at a right angle to the conveying direction in its portion guided by the ridge (72) upon leaving the conveying channel (41).

The feed mechanism is used in such a manner according to the process of the invention that the fiber sliver delivered from the delivery point—in the example the exit (940) in combination with the conveyor rollers (950)—is grasped and transferred to the feed mechanism which then introduces the fiber sliver into the drafting equipment without further interventions. The process makes it possible to render much more effective a resumption or continuation of the work process of the textile machine. The fiber sliver can here not only be grasped by hand, but also by means of an automatic grasper which then transfers the sliver in a controlled manner to the feed mechanism. The fiber sliver is in that case introduced first into the sliver storage, and is then introduced via the deflection point located in the path of the sliver into the measuring device, is then held in front of the conveyor which grasps it and draws it in. For this purpose, the air supply to the conveyor is actuated. This can be effected by an operator of the textile machine or automatically, e.g. by means of sensors and a control unit. In the same manner, the additional interventions in the textile machine are controlled. These are, e.g., the lowering of the delivery speed of the sliver, subjecting the drafting equipment to suction as well as shutting off the conveying air. The delivery speed is not practicable on every textile machine. This is possible e.g. in particular for the delivery of the sliver from presentation cans or in similar instances.

The design of the conveying channel as a tubular component is only an example of one embodiment. Just as advantageously, it is possible to use a conveying channel which is not at all, or is only partially closed. It may, for instance, be made entirely or partially in the form of a gutter or entirely or partially in the form of a channel, without falling outside the framework of the invention. This also applies to the drive arrangement which is assigned to a conveying channel of such a design. It may also be made in the form of a component that is only partially closed over its circumference, for example, independently of the configuration of the conveying channel itself.

It should be appreciated by those skilled in the art that various modifications and variations can be made in the present invention without departing from the scope and spirit of the invention.

What is claimed is:

1. A process for conveying fibers from a delivery point of a textile machine to a drafting equipment for further processing, said process comprising forming the fibers into a fiber sliver and conveying the fiber sliver with a feed mechanism along at least part of the path between the delivery point and the drafting equipment, and introducing the fiber sliver into the drafting equipment with the feed mechanism, said step of conveying with a feed mechanism further comprising establishing a positive pressure conveying airstream at the intake end of a channel disposed between the delivery point and the drafting equipment, and conveying the fiber sliver through the channel with the airstream to a location directly adjacent the drafting equipment.

2. The process as in claim 1, comprising forming the fibers into the fiber sliver without imparting rotation to the fiber sliver.

3. The process as in claim 1, further comprising transferring the fiber sliver from the delivery point to the feed mechanism with a transferring device.

4. The process as in claim 1, further comprising reducing a conveying speed of the fiber sliver from an operational production speed during said introducing of the fiber sliver to the drafting equipment.

5. The process as in claim 4, further comprising reducing any suction on the drafting equipment during said introducing of the fiber sliver to the drafting equipment.

6. The process as in claim 1, further comprising removing the conveying air from the feed mechanism upstream of the drafting equipment generally at the exit end of the channel so that the airstream moves from one end of the channel to the opposite exit end.

7. The process as in claim 1, comprising directing the conveying air in the conveying channel essentially parallel to inside wall of the channel.

8. A process for conveying fibers from a delivery point of a textile machine to a drafting equipment for further processing, said process comprising forming the fibers into a fiber sliver and conveying the fiber sliver with a feed mechanism along at least part of the path between the delivery point and the drafting equipment, introducing the fiber sliver into the drafting equipment with the feed mechanism, pneumatically conveying the fiber sliver through a conveying channel in the feed mechanism, and further comprising switching off the conveying air after the fiber sliver has been introduced to the drafting equipment.

9. An apparatus for feeding a fiber sliver in a textile machine from a point of delivery to drafting equipment for further processing of the fiber sliver, said apparatus comprising:

at least one feed mechanism disposed between said fiber sliver delivery point upstream of said drafting equipment and an input area of said drafting equipment;

said feed mechanism comprising a conveying channel through which the fiber sliver passes, said conveying channel having an end disposed at said input area so as to introduce the fiber sliver to said drafting equipment; said feed mechanism further comprising a drive arrangement configured with said conveying channel to convey the fiber sliver therethrough in a speed variable manner; and wherein said drive arrangement comprises a pneumatic system disposed at an intake end of said conveying channel adjacent to said fiber sliver delivery point so as to generate a Positive pressure conveying airstream directed along substantially the entire length of said channel.

10. The apparatus as in claim 9, wherein said drafting equipment comprises a cover, said conveying channel extending through said cover.

11. The apparatus as in claim 4, wherein said conveying channel extends to adjacent input rollers of said drafting equipment so as to convey the fiber sliver directly to said rollers.

12. The apparatus as in claim 9, wherein said conveying channel has a closed circumference along at least a portion thereof.

13. The apparatus as in claim 9, wherein said pneumatic system comprises at least one nozzle disposed to direct said air stream generally parallel to sides of said conveying channel.

14. The apparatus as in claim 9, wherein said drive arrangement comprises a seat for said conveying channel, said conveying channel having an end engaged with said seat.

15. The apparatus as in claim 14, wherein said seat is engaged around said end of said conveying channel.

16. The apparatus as in claim 9, wherein said conveying channel has a centerline axis directed to input rollers of said drafting equipment.

17. The apparatus as in claim 16, wherein said centerline axis is directed to an upper roller of said input rollers.

18. The apparatus as in claim 16, wherein said conveying channel is adjustable along a direction generally perpendicular to said input rollers.

19. The apparatus as in claim 18, wherein said conveying channel is connected to a support of said input rollers so that said input rollers move with said conveying channel along said adjustable direction with a distance between said conveying channel and said input rollers remaining constant.

20. The apparatus as in claim 9, wherein said conveying channel includes an air vent.

21. The apparatus as in claim 9, wherein said conveying channel is separable from said drive arrangement.

22. The apparatus as in claim 9, further comprising a fiber sliver measuring device disposed between the delivery point and said drafting equipment.

23. The apparatus as in claim 22, wherein said measuring device is disposed between said delivery point and said conveying channel.

24. The apparatus as in claim 9, further comprising a transfer mechanism disposed to transfer the fiber sliver from said delivery point to said conveying channel.

25. The apparatus as in claim 9, wherein in a conveying channel is pivotal away from a conveying path of the fiber sliver.

26. An apparatus for feeding a fiber sliver in a textile machine from a point of delivery to drafting equipment for further processing of the fiber sliver, said apparatus comprising:

at least one feed mechanism disposed between said fiber sliver delivery point upstream of said drafting equipment and an input area of said drafting equipment;

said feed mechanism comprising a conveying channel through which the fiber sliver passes, said conveying channel having an end disposed at said input area so as to introduce the fiber sliver to said drafting equipment;

said feed mechanism further comprising a drive arrangement configured with said conveying channel to convey the fiber sliver therethrough in a speed variable manner;

wherein said drive arrangement comprise a pneumatic system configured to generate a conveying air stream through said conveying channel;

wherein said pneumatic system comprises at least one nozzle disposed to direct said air stream generally parallel to sides of said conveying channel; and further comprising a cover screening said nozzle from the fiber sliver conveyed thereby.

27. The apparatus as in claim 26, wherein said nozzle comprises a cylindrical component having an axial length extending parallel to said conveying channel.

28. An apparatus for feeding a fiber sliver in a textile machine from a point of delivery to drafting equipment for further processing of the fiber sliver, said apparatus comprising:

at least one feed mechanism disposed between said fiber sliver delivery point upstream of said drafting equipment and an input area of said drafting equipment;

said feed mechanism comprising a conveying channel through which the fiber sliver passes, said conveying channel having an end disposed at said input area so as to introduce the fiber sliver to said drafting equipment;

said feed mechanism further comprising a drive arrangement configured with said conveying channel to convey the fiber sliver therethrough in a speed variable manner; and wherein said conveying channel includes a fiber spreading device adjacent an outlet thereof before said drafting equipment.

* * * * *